US006447392B1

(12) United States Patent
Henderson

(10) Patent No.: US 6,447,392 B1
(45) Date of Patent: Sep. 10, 2002

(54) ONE SIDED ROOF VENT

(76) Inventor: John C. Henderson, 335 Summit Rd., Springfield, PA (US) 19064

( * ) Notice: Subject to any disclaimer, the term of this patent is extended or adjusted under 35 U.S.C. 154(b) by 0 days.

(21) Appl. No.: 09/923,196

(22) Filed: Aug. 6, 2001

Related U.S. Application Data

(60) Provisional application No. 60/227,419, filed on Aug. 23, 2000.

(51) Int. Cl.[7] ..... F24F 7/02

(52) U.S. Cl. ..... 454/365; 52/199; 454/366

(58) Field of Search ..... 454/82, 107, 115, 454/136, 162, 365, 366; 52/198, 199

(56) References Cited

U.S. PATENT DOCUMENTS 4,843,953 A * 7/1989 Sells ..... 454/365
5,439,417 A * 8/1995 Sells ..... 16/225
5,704,834 A * 1/1998 Sells ..... 454/365
5,946,868 A * 9/1999 Morris ..... 454/365
5,947,817 A * 9/1999 Morris et al. ..... 454/365
6,212,833 B1 * 4/2001 Henderson ..... 454/365 X

* cited by examiner

*Primary Examiner*—Harold Joyce
(74) *Attorney, Agent, or Firm*—John S. Munday

(57) ABSTRACT

A vent device includes a rectangular configuration having a linear axis and edges forming a lift end and a no lift end. The no lift end has a predetermined thickness to thereby define a base cross section. The lift end has a predetermined thickness of at least twice that of the base cross section. The lift end has an opening for transferring air from the environment outside the structure to an opening communicating with its interior. The lift end may have at least two sets of layers to support the device at at least three locations having decreasing cross sectional height at the lift end, the interior position and the no lift end respectively. An optional pivot point permits the device to conform to the structure. Also optionally provided is a baffle or a cover filter to protect environmental particles.

20 Claims, 2 Drawing Sheets

ONE SIDED ROOF VENT

This application claims priority from provisional application No. 60/227,41 filed Aug. 23, 2000.

FIELD OF THE INVENTION

This invention relates to a roof vent device for permitting hot air to escape from an attic area. More particularly, the invention relates to a one sided roof vent for providing a vent on one side of a roof portion to reduce or substantially eliminate rain, turbulence and wind disturbances from interfering with the venting process.

BACKGROUND OF THE INVENTION

At the present time, roof vents are mounted along the roof ridge to provide a vent from the attic area of a house or other structure, to reduce the build-up of heat in the summer. While venting roofs is a necessary part of house construction, use of auxiliary vents are not cost effective. Specifically, the use of separate exhaust fans and vents adds significant cost to the dwelling and have considerably shorter effective life-spans.

In order to preserve the appearance of the house, the height of the vent is kept at a minimum For that reason, conventional roof vents are open on both sides of the roof ridge, so that they cooperate with a slit or opening in the roof decking to allow air to vent in both directions. Because of this conventional design, the house roof is exposed to high wind, rain and storms in both directions perpendicular to the length of the roof along the roof ridge. This causes damage to the roof deck, sheathing and tarpaper.

It is estimated that, in the United States, westerly driven winds are associated with 90% of the damaging high winds from storms. Manufacturers of conventional two sided roof vents are forced to protect themselves against damage claims by substantial insurance claims. If a conventional vent were to be used on only one side of the roof ridge line, the opening would have to be so large to be effective that even more damage to the roof deck and perhaps other parts of the attic and roof system. A larger opening would not be facing these westerly winds, of course, but the size itself would still provide undesirable access to the interior of the roof.

It would be of great advantage in the art if a roof vent system could be provided that would eliminate significant exposure to prevailing storm winds and the like, while permitting venting of the attic in a simple, easy to install and attractive manner, allowing continuous uninterrupted air flow.

It is therefore an object of this invention to provide an improved roof vent.

Another object is to provide a roof ridge vent device that is easy to install in conventional roof construction, utilizing conventional roof decking construction while providing continuous ventilation.

Yet another object of the present invention is to provide a roof vent while eliminating at least half of any lift up to which the roof would conventionally be exposed.

Other objects will appear hereinafter.

SUMMARY OF THE INVENTION

It has now been discovered that the above and other objects of the present invention may be accomplished in the following manner. The unique aspect of this invention is the use of a vent device for a framed roof structure and the like.

The device is constructed so it may be used at any location on the roof that is in communication with an area of the structure where venting is necessary or simply desirable. For example, the device of the present invention is to be used at any location around a building, including the roof ridge, soffit area, hip area, facia areas, walls, and others, to provide proper ventilation in unventilated or poorly ventilated areas. The present invention may also be used on the walls and/or the roof, or can be used anywhere on a building or other structure where proper ventilation is required or desired.

The device functions such that when used at the ridge, for example, a negative air pressure is developed when wind blows from the no lift side across the ridge and then flows above and perpendicular to the lift up side of the device. The device has a no lift side and a lift side, preferably divided in the middle where the device may, if desired, be able to bend in one or both directions about a center line parallel to the ends of the two sides.

It is not necessary to have the divided middle, and this is a preferred embodiment when the device requires bending. The device can be used anywhere on a structure, and particularly lower on the roof so that the device fits without bending.

The material used to construct this planar one sided lifted vent may be corrugated plastic of a range of thicknesses. Any material that permits air penetration along the axis of desired air flow may be used to construct the device described herein.

The invention permits air to ventilate with only one side exposed to the environment and provides a physics-based solution to drawing air from poorly vented areas. The manufacture of this device is substantially less costly than prior art two-sided lift up vents.

BRIEF DESCRIPTION OF THE DRAWINGS

For a more complete understanding of the invention, reference is hereby made to the drawings, in which.

DETAILED DESCRIPTION OF THE PREFERRED EMBODIMENT

Figure 1:
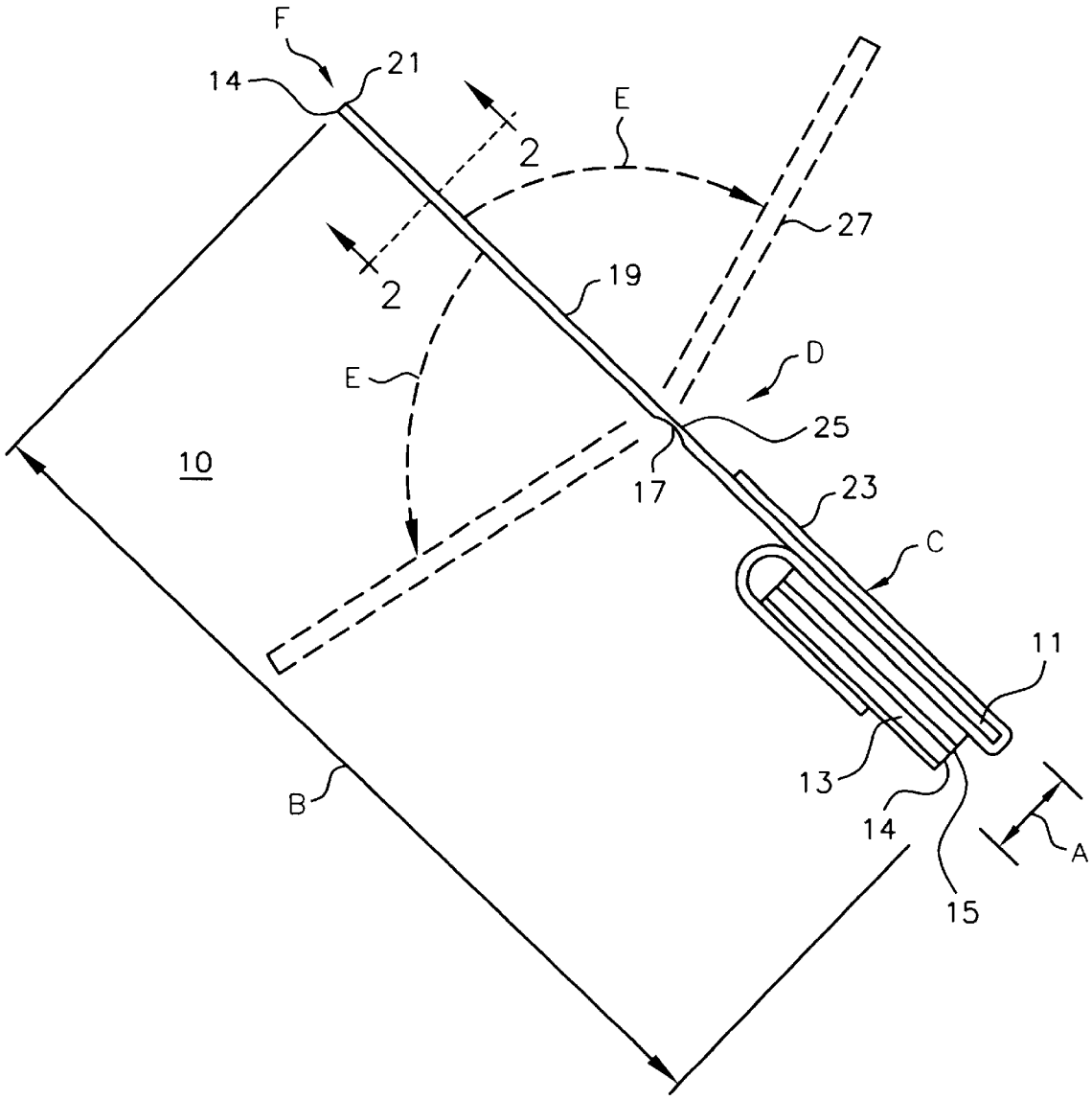
FIG. 1 is a cross sectional view of the design of the present invention, with the device as sold shown in solid lines and the optionally moveable portion or no lift side shown in two different positions in dashed lines.
Figure 2:
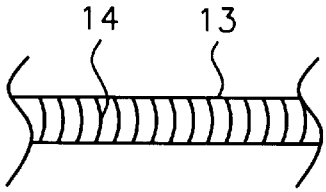
FIG. 2 is a cross sectional view of the device of FIG. 1, taken along the line 2—2.

The present invention is useful for most forms of roofing. The device, 10 generally in FIG. 1, has upper and lower surfaces sized to define a generally rectangular configuration having a linear axis. The device 10 includes a lift end 11 having a thickness A, which lift end 11 comprises a plurality of layers 13 (three are shown in FIG. 1) that are corrugated or otherwise shaped to provide channels 14 for air flow from the opening 15 of lift end 11 to the center 17 of the device. The linear axis goes into the drawing and is parallel to lift end 11.

The layers 13 is, in one preferred embodiment a 4 mm thick black polyethylene corrugated sheet, but can be any material such as, for example, polypropylene, and may have any shape that provides the air passages as set forth above. Examples of suitable materials are molded plastics, fabricated plastic sheets or rolls, aluminum or other metal sheets with corrugations to provide air passages, and combinations of materials. All that is required is that the layers 13 be capable of providing passageways or channels 14 for air flow from one part to another part of the device. The thickness of the no lift end 21 is the thickness of the base 19.

The channels 14 in layers 13 is supported on a support base 19, also made from polyethylene corrugated sheet to provide a plurality of air passages as is the lift end portion 11. Support base 19 can also be formed as part of layers 13 by folding base 19 integrally at one time or base 19 and layers 13 can be separately formed and attached to one another. The lift end 11 is formed from several folded or stacked portions, each of which is preferably the same size as one layer 19 of no lift end 21, so that at least one step differential in cross sectional thickness is achieved. As previously noted, lift end 11 has two layers 13 added to base 19 to form a three tier step differential. At least one layer 13 is necessary and the maximum number of layers 13 is limited only by design choice to permit adequate venting of the structure to which it is to be attached.

Figure 3:
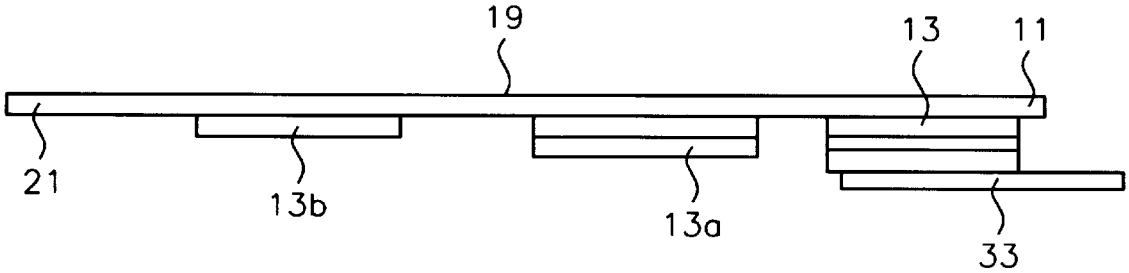
FIG. 3 is a cross sectional view of another embodiment of the present invention showing alternative options.

Overlapping the lift end 11 in FIG. 1 is a fabric 23, which acts as a filter to protect the device from insects, wind, snow and dust, no matter what direction the air flow of the device is aligned to permit. In some instances, fabric 23 may be eliminated from the device, when the environment is suitable. An alternative is shown in FIG. 3, where a wind baffle 33 is attached to lift end 11. Also shown in FIG. 3 is a lift end where stacks 13, 13*a* and 13*b* have decreasing height so that the lift is supported along the entire device. The device of FIG. 3 does not have a pivot point, like pivot point 17 of FIG. 1, as this is an optional feature.

While the size of the device is not critical to the function as a vent, the length B of a specific device built for the purpose of reducing the invention to practice was 10.5 inches in thickness. The thickness A for the device was ¾ inches or 18.75 mm in thickness. The thickness F is about 0.16 inches or 4 mm, which is the thickness of the composite material and, when folded, as the layers 13. Pivot point 25, located proximate the middle of the device, say at 5.25 inches in the experimental model, permits the device to be folded to positions other than straight, as shown by dashed lines 27 and arrow E. These sizes are merely illustrative and are not to be construed as limitations on the size of the device of this invention. Size is to be determined by the particular structure on which the device is to be used to permit adequate venting of inside regions of the structure, such as, by way of example and not limitation, along different portions of the roof or walls of a house. As has been shown above, a non-pivoting vent device is to be utilized at specific applications in various places on the structure.

The center 17 at pivot point 25 includes a gap or opening that extends over the linear axis of the device. The gap serves as an entrance for an air tunnel to the vent, for example in a roof ridge, to vent air from beneath the roof ridge. The gap defines pivot point 25, about which the configuration can be folded to conform to a roof having any roof pitch.

Pivot point 25 also provides for easy installation of the present invention since there is no resisting matrix at pivot point 25, but rather is a thin area about which the configuration folds to conform to a roof pitch having a predetermined angle. The angle is determined by the construction of the roof and may be anywhere from less than 45°, to 90° as shown in FIG. 1, to more than 135°. In any configuration, the device of this invention functions effectively to provide a superior vent.

While particular embodiments of the present invention have been illustrated and described, it is not intended to limit the invention to any specific embodiment. The dimensions and materials given are for the preferred embodiment and are not to be construed as limitations on the scope of this invention. The description of the invention is not intended to limit the invention.

What is claimed is:

1. A vent device for use with a structure having a roof and walls exposed to the environment, comprising: upper and lower outer surfaces, said surfaces being sized to define a generally rectangular configuration having a linear axis and linear edges parallel to said axis, said configuration having a lift end and a no lift end proximate said linear edges;

said no lift end being generally flat and having a predetermined thickness to thereby define a base cross section;

said lift end being generally flat and having a predetermined thickness of at least twice that of said base cross section and having an opening, said lift end having a plurality of channels for transferring air therethrough along said lift end toward said no lift end, at least one of said upper and lower outer surfaces having an opening to permit access at said opening to said channels.

2. The device of claim 1, wherein said device is positioned on a structure to expose said lift end to the environment outside of said structure.

3. The device of claim 1, which additionally includes a pivot point positioned to permit said lift end and said no lift end to pivot about said pivot point, and said pivot point includes said opening.

4. The device of claim 3, wherein said device is positioned on a roof to expose said opening in said pivot point to the environment inside said roof, and wherein said pivot point permits said device to bend in one or both directions about said axis.

5. The device of claim 1, wherein said device is positioned on a wall to expose said lift end to the environment outside said wall.

6. The device of claim 1, which further includes a baffle to prevent direct flow of environmental air into said lift end.

7. The device of claim 1, wherein said lift end comprises at least two sets of layers, the first of which is positioned proximate said lift end linear edge and the second of which is positioned closer to the interior of said device to support said device at at least three locations on said structure, said three locations having decreasing cross sectional height at said lift end, said interior position and said no lift end respectively.

8. The device of claim 1, which further includes a cover filter extending across said channels to protect the lift end of said device from insects, wind, snow or dust no matter what direction the device is aligned to permit air flow through said passages.

9. The device of claim 1, wherein said pivot point permits said device to bend in one or both directions about said axis.

10. The device of claim 1, which is formed from molded plastic.

11. The device of claim 10, where said molded plastic is selected from polyethylene and polypropylene corrugated sheet.

12. The device of claim 10, where said molded plastic is nylon.

13. The device of claim 1, wherein said device is formed from metal.

14. The device of claim 13, wherein said metal is aluminum.

15. A method of venting a structure having a roof and walls exposed to the environment and having unventilated or poorly ventilated areas, comprising the steps of:

forming a vent device having an upper and lower outer surfaces, said surfaces being sized to define a generally rectangular configuration having a linear axis and linear edges, said configuration having a lift end and a no lift end proximate said linear edges; said no lift end being generally flat and having a predetermined thickness to thereby define a base cross section; a said lift end being generally flat and having a predetermined thickness at one end thereof of at least twice that of said base cross section and having an opening; said lift end having a plurality of channels for transferring air therethrough; said lower outer surface having an opening in communication with said passages to permit access at said opening to said passages;

positioning said device to place said lift end on said structure to expose said lift end to the environment outside said structure; and positioning said device to expose said opening to the environment inside said structure.

16. The method of claim 15, which further including the step of bending said device about said axis by forming a said pivot point to permit said device to conform to its position on said structure.

17. The method of claim 15, wherein said lift end comprises at least two sets of layers, the first of which is positioned proximate said lift end linear edge and the second of which is positioned closer to the interior of said device to support said device at at least three locations on said structure, said three locations having decreasing cross sectional height at said lift end, said interior position and said no lift end respectively.

18. The method of claim 15, which further includes the step of placing a cover filter to protect the lift end of said device from insects, wind, snow or dust no matter what direction the device is aligned to permit air flow through said passages.

19. The method of claim 15, wherein said vent device is formed from molded plastic.

20. The method of claim 19, where said vent device is formed from a material selected from polyethylene corrugated sheet, polypropylene corrugated sheet, nylon, and aluminum.

* * * * *

US006447392C1

(12) EX PARTE REEXAMINATION CERTIFICATE (8500th)

United States Patent

Henderson

(10) Number: US 6,447,392 C1

(45) Certificate Issued: Aug. 30, 2011

(54) ONE SIDED ROOF VENT

(76) Inventor: John C. Henderson, Springfield, PA (US)

Reexamination Request:
No. 90/010,827, Jan. 14, 2010

Reexamination Certificate for:

| | |
|---|---|
| Patent No.: | **6,447,392** |
| Issued: | **Sep. 10, 2002** |
| Appl. No.: | **09/923,196** |
| Filed: | **Aug. 6, 2001** |

Related U.S. Application Data

(60) Provisional application No. 60/227,419, filed on Aug. 23, 2000.

(51) Int. Cl.
*F24F 7/02* (2006.01)

(52) U.S. Cl. ..... 454/365; 52/199; 454/366

(58) Field of Classification Search ..... None
See application file for complete search history.

(56) References Cited

U.S. PATENT DOCUMENTS

| | | | | |
|---|---|---|---|---|
| 4,000,688 | A | 1/1977 | Malott | 98/42 |
| 4,325,290 | A | 4/1982 | Wolfert | 98/42 |
| 4,643,080 | A | 2/1987 | Trostle et al. | 98/42.21 |
| 4,942,699 | A | 7/1990 | Spinelli | 52/57 |
| 5,095,810 | A | 3/1992 | Robinson | |
| 5,651,734 | A | 7/1997 | Morris | |
| 5,673,521 | A | 10/1997 | Coulton | |
| 5,704,834 | A | 1/1998 | Sells | |
| 5,832,677 | A | 11/1998 | Kurttila | 52/95 |
| 5,946,868 | A | 9/1999 | Morris | |
| 5,947,817 | A | 9/1999 | Morris et al. | 454/365 |

*Primary Examiner*—Aaron J. Lewis

(57) ABSTRACT

A vent device includes a rectangular configuration having a linear axis and edges forming a lift end and a no lift end. The no lift end has a predetermined thickness to thereby define a base cross section. The lift end has a predetermined thickness of at least twice that of the base cross section. The lift end has an opening for transferring air from the environment outside the structure to an opening communicating with its interior. The lift end may have at least two sets of layers to support the device at at least three locations having decreasing cross sectional height at the lift end, the interior position and the no lift end respectively. An optional pivot point permits the device to conform to the structure. Also optionally provided is a baffle or a cover filter to protect environmental particles.

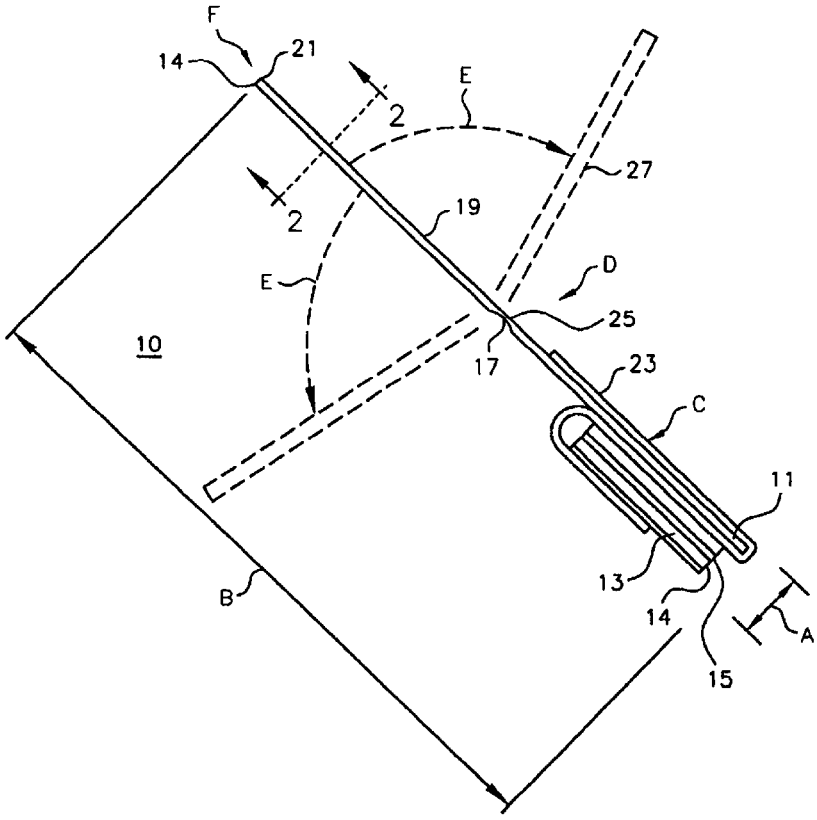

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 6, 7, 10, 13, 15, 17 and 18-20 are determined to be patentable as amended.

Claims 2-5, 8, 9, 11, 12, 14 and 16, dependent on an amended claim, are determined to be patentable.

New claims 21-61 are added and determined to be patentable.

1. A vent device for use with a structure having a roof and walls exposed to the environment, comprising: upper and lower outer surfaces, said surfaces being sized to define a generally rectangular configuration having a linear axis and linear edges parallel to said axis, said configuration having a lift end and a no lift end proximate said linear edges, *said linear edges being substantially equidistant from said linear axis*;

said no lift end being generally flat and having a predetermined thickness to thereby define a base cross section;

said lift end being generally flat and having a predetermined thickness of at least twice that of said base cross section and having an opening, said lift end having a plurality of channels for transferring air therethrough along said lift end toward said no lift end, at least one of said upper and lower outer surfaces having an opening to permit access at said opening to said channels.

6. [The device of claim 1.] *A vent device for use with a structure having a roof and walls exposed to the environment, comprising: upper and lower outer surfaces, said surfaces being sized to define a generally rectangular configuration having a linear axis and linear edges parallel to said axis, said configuration having a lift end and a no lift end proximate said linear edges;*

*said no lift end being generally flat and having a predetermined thickness to thereby define a base cross section;*

*said lift end being generally flat and having a predetermined thickness of at least twice that of said base cross section and having an opening, said lift end having a plurality of channels for transferring air therethrough along said lift end toward said no lift end, at least one of said upper and lower outer surfaces having an opening to permit access at said opening to said channels;* which further includes a baffle to prevent direct flow of the environmental air into said lift end.

7. [The device of claim 1] *A vent device for use with a structure having a roof and walls exposed to the environment, comprising: upper and lower outer surfaces, said surfaces being sized to define a generally rectangular configuration having a linear axis and linear edges parallel to said axis, said configuration having a lift end and a no lift end proximate said linear edges;*

*said no lift end being generally flat and having a predetermined thickness to thereby define a base cross section;*

*said lift end being generally flat and having a predetermined thickness of at least twice that of said base cross section and having an opening, said lift end having a plurality of channels for transferring air therethrough along said lift end toward said no lift end, at least one of said upper and lower outer surfaces having an opening to permit access at said opening to said channels*, wherein said lift end comprises at least two sets of layers, the first of which is positioned proximate said lift end linear edge and the second of which is positioned closer to the interior of said device to support said device at at least three locations on said structure, said three locations having decreasing cross sectional height at said lift end, said interior position and said no lift end respectively.

10. The device of claim [1] *6*, which is formed from molded plastic.

13. The device of claim [1] *6*, wherein said device is formed from metal.

15. A method of venting a structure having a roof and walls exposed to the environment and having unventilated or poorly ventilated areas, comprising the steps of:

forming a vent device having an upper and lower outer surfaces, said surfaces being sized to define a generally rectangular configuration having a linear axis and linear edges, said configuration having a lift end and a no lift end proximate said linear edges, *said linear edges being substantially equidistant from said linear axis*; said no lift end being generally flat and having a predetermined thickness to thereby define a base cross section; a said lift end being generally flat and having a predetermined thickness at one end thereof of at least twice that of said base cross section and having an opening; said lift end having a plurality of channels for transferring air therethrough; said lower outer surface having an opening in communication with said passages to permit access at said opening to said passages;

positioning said device to place said lift end on said structure to expose said lift end to the environment outside said structure; and positioning said device to expose said opening to the environment inside said structure.

17. [The method of claim 15] *A method of venting a structure having a roof and walls exposed to the environment and having unventilated or poorly ventilated areas, comprising the steps of:*

*forming a vent device having an upper and lower outer surfaces, said surfaces being sized to define a generally rectangular configuration having a linear axis and linear edges, said configuration having a lift end and a no lift end proximate said linear edges; said no lift end being generally flat and having a predetermined thickness to thereby define a base cross section; a said lift end being generally flat and having a predetermined thickness at one end thereof of at least twice that of said base cross section and having an opening; said lift end having a plurality of channels for transferring air therethrough; said lower outer surface having an opening in communication with said passages to permit access at said opening to said passages;*

*positioning said device to place said lift end on said structure to expose said lift end to the environment outside said structure; and*

*positioning said device to expose said opening to the environment inside said structure*, wherein said lift end comprises at least two sets of layers, the first of which is positioned proximate said lift end linear edge and the second of which is positioned closer to the interior of said device to support said device at at least three locations on said structure, said three locations having decreasing cross sectional height at said lift end, said interior position and said no lift end respectively.

18. The method of claim 15, which further includes the step of placing a cover filter to protect the lift end of said device from [insects,] wind, snow or dust no matter what direction the device is aligned to permit air flow through said passages.

19. The method of claim [15] *17*, wherein said vent device is formed from molded plastic.

20. The method of claim [19] *17*, where said vent device is formed from a material selected from polyethylene corrugated sheet, polypropylene corrugated sheet, nylon, and aluminum.

*21. The device of claim 7, which is formed from molded plastic.*

*22. The device of claim 21, where said molded plastic is selected from polyethylene and polypropylene corrugated sheet.*

*23. The device of claim 21 wherein said molded plastic is nylon.*

*24. The device of claim 7 wherein said device is formed from metal.*

*25. The device of claim 24 wherein said metal is aluminum.*

*26. The device of claim 1, which further includes a cover filter extending across said channels to protect the lift end of said device from wind, snow or dust no matter what direction the device is aligned to permit air flow through said channels.*

*27. The device of claim 1, which further includes a cover filter extending across said channels to protect the lift end of said device from insects, wind, snow and dust no matter what direction the device is aligned to permit air flow through said channels.*

*28. The device of claim 1, which further includes a cover filter, said cover filter being composed of a fabric, said cover filter extending across said channels to protect the lift end of said device no matter what direction the device is aligned to permit air flow through said channels.*

*29. The method of claim 15, which further includes the step of placing a cover filter to protect the lift end of said device from insects, wind, snow and dust no matter what direction the device is aligned to permit air flow through said channels.*

*30. The method of claim 15, which further includes the step of placing a cover filter, said cover filter being composed of a fabric, said cover filter extending across said channels to protect the lift end of said device no matter what direction the device is aligned to permit air flow through said channels.*

*31. A vent device for use with a structure having a roof and walls exposed to the environment, comprising:*

*upper and lower outer surfaces, said surfaces being sized to define a generally rectangular configuration having a linear axis and linear edges parallel to said axis, said configuration having a lift end and a no lift end proximate said linear edges;*

*said no lift end being generally flat and having a predetermined thickness to thereby define a base cross section;*

*said lift end being generally flat and having a predetermined thickness of at least twice that of said base cross section, said lift end having a plurality of channels for transferring air therethrough along said lift end toward said no lift end, said lower outer surface defining an opening communicating with said channels;*

*a pivot point, the device having a middle, said pivot point being located proximate to said middle of the device, said pivot point permitting said lift end and said no lift end to pivot about said pivot point.*

*32. The vent of claim 31 wherein the device has a length from said lift end to said no lift end, said middle being located along said length.*

*33. The vent of claim 32 wherein said pivot point is parallel to said lift end.*

*34. The vent device of claim 33, the device further comprising: a gap, said gap defines said pivot point.*

*35. The vent device of claim 34 wherein said gap being an entrance to an air tunnel to the vent device.*

*36. The vent device of claim 33, the device further comprising: a filter, said filter being composed of a fabric, said filter overlapping said lift end and extending across said channels.*

*37. The vent device of claim 36 wherein said lift end comprises a plurality of layers, said fabric being interposed between two of said plurality of layers.*

*38. The device of claim 31, which is formed from molded plastic.*

*39. The device of claim 38 wherein said molded plastic is selected from polyethylene and polypropylene corrugated sheet.*

*40. The device of claim 38 wherein said molded plastic is nylon.*

*41. The device of claim 31 wherein said device is formed from metal.*

*42. The device of claim 41 wherein said metal is aluminum.*

*43. A vent device for use with a structure having a roof and walls exposed to the environment, comprising: upper and lower outer surfaces, said surfaces being sized to define a generally rectangular configuration having a linear axis and linear edges parallel to said axis, said configuration having a lift end and a no lift end proximate said linear edges;*

*said no lift end being generally flat and having a predetermined thickness to thereby define a base cross section;*

*said lift end being generally flat and having a predetermined thickness of at least twice that of said base cross section and having an opening, said lift end having a plurality of channels for transferring air therethrough along said lift end toward said no lift end, at least one of said upper and lower outer surface having an opening to permit access at said opening to said channels;*

*wherein said device is positioned on said roof of said structure to expose said lift end to the environment outside of said structure, said upper outer surface and said roof defining an acute angle.*

*44. The device of claim 43, which is formed from molded plastic.*

*45. The device of claim 44, where said molded plastic is selected from polyethylene and polypropylene corrugated sheet.*

*46. The device of claim 44, where said molded plastic is nylon.*

*47. The device of claim 43, wherein said device is formed from metal.*

*48. The device of claim 47, wherein said metal is aluminum.*

*49. A vent device for use with a structure having a roof and walls exposed to the environment, comprising: upper*

*and lower outer surfaces, said surfaces being sized to define a generally rectangular configuration having a linear axis and linear edges parallel to said axis, said configuration having a lift end and a no lift end proximate said linear edges;*

*said no lift end being generally flat and having a predetermined thickness to thereby define a base cross section;*

*said lift end being generally flat and having a predetermined thickness of at least twice that of said base cross section and having an opening, said lift end having a plurality of channels for transferring air therethrough along said lift end toward said no lift end, at least one of said upper and lower outer surface having an opening to permit access at said opening to said channels;*

*wherein said device is positioned on a one of said walls of said structure to expose said lift end to the environment outside of said structure, said upper outer surface and said wall defining an acute angle.*

*50. The device of claim 49, which is formed from molded plastic.*

*51. The device of claim 50, where said molded plastic is selected from polyethylene and polypropylene corrugated sheet.*

*52. The device of claim 50, where said molded plastic is nylon.*

*53. The device of claim 49, wherein said device is formed from metal.*

*54. The device of claim 53, wherein said metal is aluminum.*

*55. The device of claim 1, wherein said no lift end and said lift end are positioned on said roof to expose said lift end to the environment outside of said structure, said no lift end and said lift end not being positioned on said wall.*

*56. The device of claim 55, which additionally includes a pivot point positioned to permit said lift end and said no lift end to pivot about said pivot point.*

*57. The device of claim 56, wherein said device is positioned on a roof to expose said opening in at least one of said upper and lower outer surfaces to the environment inside said roof, and wherein said pivot point permits said device to bend in one or both directions about said axis.*

*58. The device of claim 1, wherein said lift end and said no lift end are positioned on said wall to expose said lift end to the environment outside said wall, said lift end and said no lift end not being positioned on said roof.*

*59. The device of claim 1, the device further comprising: a pivot point, the device having a middle, said pivot point being located at said middle of the device and parallel to said lift end and said no lift end wherein said pivot point permits said device to bend in one or both directions about said axis.*

*60. The method of claim 15, which further including the step of bending said device about said axis by forming a pivot point to permit said device to conform to its position on said structure, said pivot point located proximate a middle of the device.*

*61. The method of claim 15, which further includes the step of placing a cover filter to protect the lift end of said device from wind, snow or dust no matter what direction the device is aligned to permit air flow through said passages.*

* * * * *